US008640310B2

(12) United States Patent
Caniparoli

(10) Patent No.: US 8,640,310 B2
(45) Date of Patent: Feb. 4, 2014

(54) DISENGAGEABLE CLIP AND ASSOCIATED ARTICLE

(75) Inventor: Jeffrey L. Caniparoli, Milwaukie, OR (US)

(73) Assignee: Leatherman Tool Group, Inc., Portland, OR (US)

( * ) Notice: Subject to any disclaimer, the term of this patent is extended or adjusted under 35 U.S.C. 154(b) by 840 days.

(21) Appl. No.: 12/370,661

(22) Filed: Feb. 13, 2009

(65) Prior Publication Data

US 2010/0205782 A1 Aug. 19, 2010

(51) Int. Cl.
*A45F 5/02* (2006.01)

(52) U.S. Cl.
USPC ..... 24/3.12; 24/537; 24/11 R; 24/11 HC

(58) Field of Classification Search
USPC ..... 24/3.1, 11 R, 11 HC, 11 C, 3.12, 3.11, 24/339, 537; 401/104; 294/100; 285/406, 285/308
See application file for complete search history.

(56) References Cited

U.S. PATENT DOCUMENTS

| | | | | | |
|---|---|---|---|---|---|
| 520,053 | A * | 5/1894 | Hopkins | 224/182 |
| 996,340 | A * | 6/1911 | Hopkins | 224/248 |
| 1,237,826 | A * | 8/1917 | Satterquist et al. | 294/7 |
| 1,274,006 | A * | 7/1918 | Clarke et al. | 24/517 |
| 1,343,514 | A * | 6/1920 | Lindsay | 24/532 |
| 1,371,771 | A * | 3/1921 | Beck | 15/432 |
| 1,457,379 | A * | 6/1923 | Mareau | 294/100 |
| 2,042,891 | A * | 6/1936 | Gailey | 131/258 |
| 2,457,736 | A * | 12/1948 | Schmidt | 24/337 |
| 2,583,680 | A * | 1/1952 | Brennan | 43/43.1 |
| 2,606,526 | A * | 8/1952 | Lound | 119/714 |
| 3,100,324 | A * | 8/1963 | Tutino et al. | 24/346 |
| 3,469,864 | A * | 9/1969 | Guerrero | 285/308 |
| 4,214,686 | A * | 7/1980 | Dostourian | 224/667 |
| 4,308,981 | A * | 1/1982 | Miura | 223/96 |
| 6,332,247 | B1 * | 12/2001 | Hsieh | 24/11 R |
| 6,435,583 | B1 * | 8/2002 | Reist | 294/116 |
| D531,743 | S | 11/2006 | Opolka | |
| 7,179,004 | B2 * | 2/2007 | Cetera | 401/131 |

* cited by examiner

*Primary Examiner* — Robert J Sandy
*Assistant Examiner* — Michael Lee
(74) *Attorney, Agent, or Firm* — Alston & Bird LLP

(57) ABSTRACT

A disengageable clip is provided which has a first configuration to permit an item to be securely gripped and a second configuration that permits the item to be disengaged. Once disengaged, the clip may be removed from the item and/or may be repositioned and then reattached to the item. The clip may include a clip member having an engagement portion defining an open loop and a clip portion extending therefrom. The clip may also include a sleeve slidably positioned upon the clip portion and at least one stop having a width greater than the sleeve. The sleeve may be configured to translate along the clip portion between first and second positions. The first position is proximate the engagement portion and may cause the engagement portion to grip the item. Conversely, the second position is spaced from the engagement portion by the stop to permit disengagement from the item.

20 Claims, 7 Drawing Sheets

DISENGAGEABLE CLIP AND ASSOCIATED ARTICLE

TECHNOLOGICAL FIELD

Embodiments of the present invention relate generally to clips for securing an item to another article and, more particularly, to clips that are selectively disengageable from the item.

BACKGROUND OF THE INVENTION

A wide variety of items include clips that permit an item to be temporarily secured to another article. For example, writing implements, such as pens, frequently include a clip for permitting the writing implement to be temporarily attached to a pocket, a notebook or the like when the writing implement is not in use. In this regard, the clip generally includes a resilient, elongate member that extends lengthwise along the writing implement with the distal end of the elongate member capable of being separated from the writing implement such as by the insertion of a piece of clothing, a piece of paper or the like between the clip and the writing implement. Since the elongate member is biased toward the remainder of the writing implement, however, the clip grips the piece of clothing, piece of paper, etc. While writing implements commonly include clips, a wide variety of other items, such as portable electronic devices including pagers and music players, may also include clips.

Clips may be integral with an item, such as in instances in which a clip is integral to the cap of a pen. However, it is sometimes desirable to remove the clip from the item, such as in instances in which the clip is no longer necessary or in instances in which the clip may be an obstruction to the intended use of the item. As such, some clips are formed as a discrete component that may be attached to the item, but may later be detached if so desired. For example, an item may include a clip that is positioned relative to the item so as to facilitate the use of the item in a certain manner. If the item is to be used in other manners, however, the clip may prevent or limit the desired use of the item and, as a result, may be removed from the item.

Notwithstanding the various clips that have been developed, it would be desirable to provide improved clips, particularly improved clips that may securely engage an item and, when desired, be disengaged from the item.

BRIEF SUMMARY OF THE INVENTION

A disengageable clip is provided according to embodiments of the present invention which has a first configuration in which the clip securely grips an item and a second configuration that permits the clip to be disengaged from the item. Once disengaged, the clip may be removed from the item and/or may be repositioned and then reattached to the item. In instances in which the clip is repositioned and reattached to the item, the clip advantageously provides increased flexibility since the position and orientation of the clip may be altered depending, for example, upon the use of the item. In addition to the clip, an article including both the clip and an item to which the clip is configured to be attached is also provided according to embodiments of the present invention.

In one embodiment, a clip is provided that includes a clip member extending continuously between first and second opposed ends. The clip member may include an engagement portion configured to extend at least partially circumferentially about an item. In one embodiment, the engagement portion includes first and second arms configured to extend partially circumferentially about the item. The clip member may also include a clip portion configured to extend from the engagement portion in a lengthwise direction along the item. The clip of this embodiment may also include a sleeve slidably positioned upon the clip portion and configured to translate along the clip portion between first and second positions. The first position is proximate the engagement portion and may cause the engagement portion to grip the item. Conversely, the second position is spaced apart from the engagement portion so as to permit disengagement of the engagement portion from the item. As such, with the clip portion in the first position, the clip member may be secured to the item, while with the sleeve in the second position, the clip member may be disengaged or removed from the item.

The clip portion may include first and second leg members having respective interconnected distal portions. The clip portion may also include at least one stop positioned between the first and second positions and having a width greater than a nominal width of the sleeve. For example, the stop may be defined by an outwardly protruding portion of at least one of the first and second leg members. Regardless of the configuration of the stop, the first and second leg members of this embodiment may be configured to move toward one another in instances in which the sleeve is advanced over the stop.

In another embodiment, a clip is provided that includes a clip member having an engagement portion defining an open loop and a clip portion extending from the engagement portion. The clip of this embodiment also includes a sleeve slidably positioned upon the clip portion. Additionally, the clip portion may include at least one stop having a width greater than a nominal width of the sleeve.

The clip portion of this embodiment may be configured to extend from the engagement portion in a lengthwise direction along the item and may include first and second leg members having respective interconnected distal portions. The first and second leg members may be configured to move toward one another in instances in which the sleeve is advanced over the stop. In one embodiment, the at least one stop is defined by an outwardly protruding portion of at least one of the first and second leg members. The engagement portion may be configured to extend at least partially circumferentially about an item, such as by including first and second arms configured to extend partially circumferentially about the item.

In a further embodiment, an article is provided that includes not only a clip having a clip member with an engagement portion and a clip portion and a sleeve configured to translate along the clip portion between first and second positions, but also an item, such as a flashlight. In one embodiment, the item defines a circumferential groove with the engagement member of the clip member being disposed within the circumferential groove. The item may define the plurality of circumferential grooves with the engagement member being sized and shaped to be disposed in any one of the plurality of circumferential grooves. As such, the article of this embodiment may permit the clip to be repositioned relative to the item. Thus, the clip may be appropriately positioned relative to the item. Thus, for a variety of different uses of the item.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
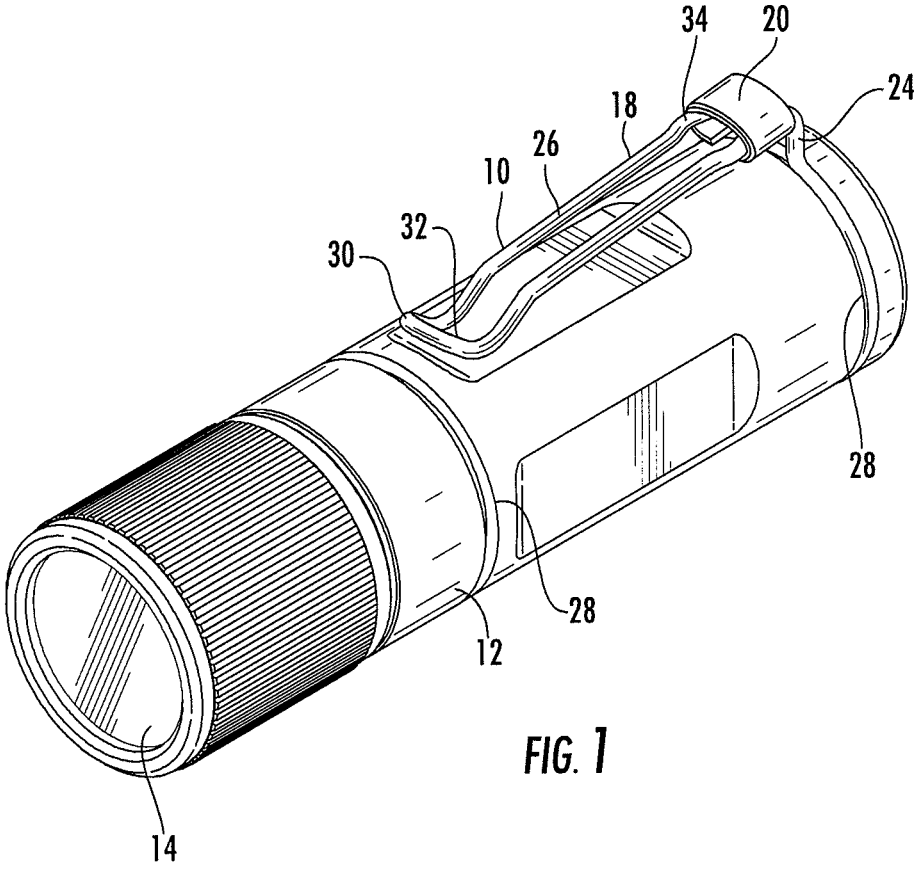
FIG. 1 is a perspective view of an article including a clip in accordance with one embodiment of the present invention.
Figure 2:
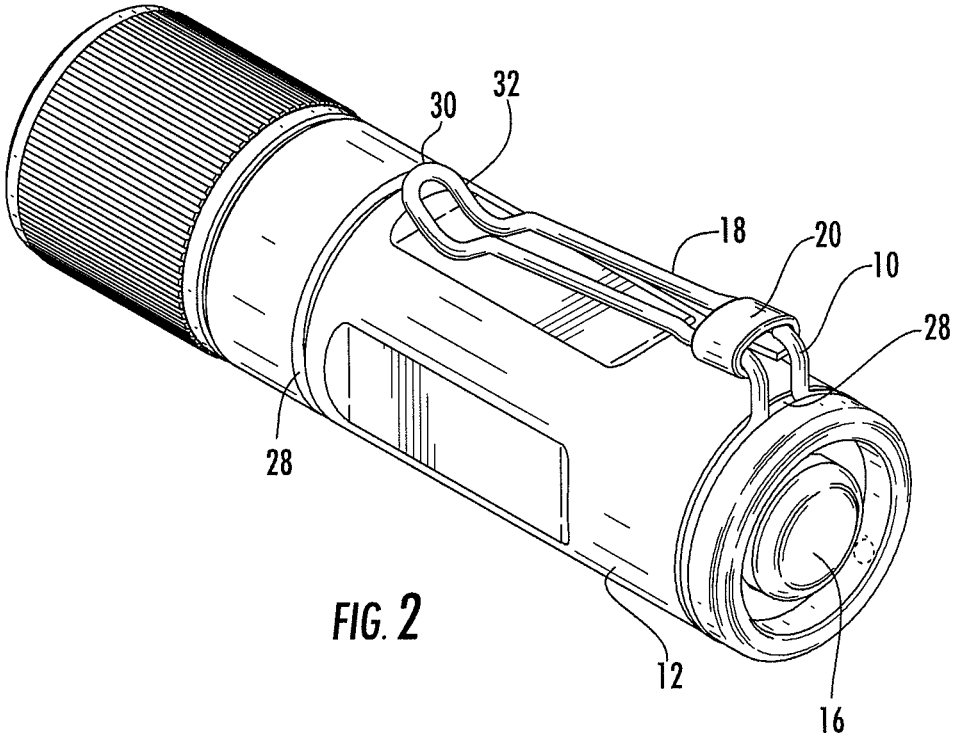
FIG. 2 is a perspective view of an article including a clip according to one embodiment of the present invention taken from a different vantage point from than FIG. 1.

Referring now to FIGS. 1 and 2, the clip 10 of one embodiment mounted upon a flashlight 12 is depicted for purposes of illustration. The flashlight of the illustrated embodiment has a housing, such a generally cylindrical or other elongated housing, extending between opposed ends. At one end, the flashlight has a lens 14 at one end through which light is emitted when the flashlight is activated, while at the other end, the flashlight has a button or switch 16 for alternately activating and deactivating the light. Within the housing, the flashlight also generally includes a power source, such as a battery, a light source, such as a light emitting diode (LED), and appropriate circuitry for interconnecting the power source, the switch and the light source.

A clip 10 is mounted to the housing of the flashlight 12 in the illustrated embodiment. As such, the clip permits the flashlight to be temporarily attached to an article, such as an article of clothing, such as a pocket, the bill of a hat or the like. While the clip is illustrated and will be described herein in conjunction with embodiments in which the clip is attached to a flashlight, the clip can be attached to a wide variety of items including handheld tools, writing instruments, personal electronic devices, etc. Moreover, while the clip of the illustrated embodiment is configured to engage the generally cylindrical housing of the flashlight, the clip may alternatively be configured to engage other items having other shapes and sizes.

Figure 3:
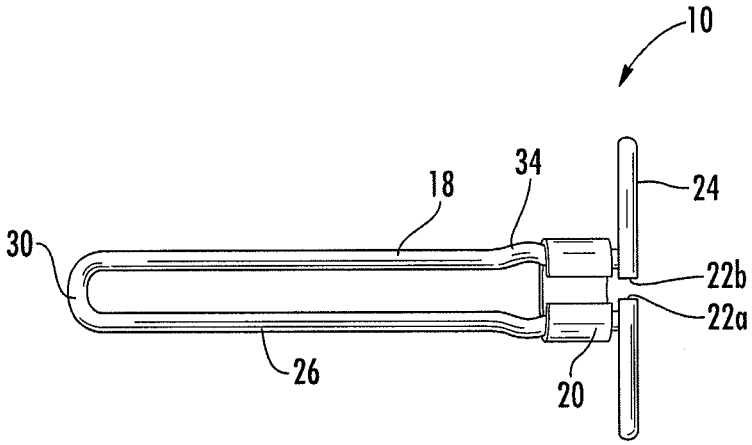
FIG. 3 is a bottom view of the clip of FIG. 1.

The clip 10 includes a clip member 18 and a sleeve 20 mounted upon the clip member. As shown in FIG. 3, the clip member of one embodiment extends continuously between first and second opposed ends 22*a*, 22*b*. In this regard, the clip member may be formed of a wire or other elongate member that is bent or formed to have the desired shape. While the clip member may be formed from a variety of materials, the clip member of one embodiment is formed from a material that is corrosion resistant and resilient such as, for example, 420 spring stainless steel. Once formed to have the desired shape, the clip member generally retains the shape in the absence of externally applied forces. However, the clip member does exhibit at least some spring-like characteristics such that even though the clip member may be deformed upon the application of sufficient external forces, the clip member will return to the shape to which it was originally formed once the external forces are removed.

The clip member 18 may include an engagement portion 24 and a clip portion 26 extending from the engagement portion. The engagement portion may define an open loop that is sized and shaped to extend at least partially circumferentially about an item, such as a flashlight 12. In this regard, the engagement portion may include first and second arms that are each configured to extend partially circumferentially about the item such that in the aggregate the first and second arms extend about more than half, e.g., greater than 180°, of the item's circumference. In the embodiment in which the clip member extends continuously between first and second opposed ends 22*a*, 22*b*, the first arm may be proximate the first end of the clip member, while the second arm is proximate the second end of the clip member. Moreover, the first and second arms generally extend from opposite sides and in opposite directions from the clip portion.

The engagement portion 24 including the first and second arms is generally formed to approximate the shape of the item to which the clip 10 will be affixed. Additionally, the engagement portion including the first and second arms is generally formed to have a nominal size in the absence of externally applied forces that is the same or slightly smaller than the portion of the item to which the clip will be affixed such that the engagement portion snugly and securely engages the item. In the illustrated embodiment, the housing of the flashlight 12 defines a circumferential groove 28 and the engagement portion is configured to be disposed within the circumferential groove so as to engage the item.

Figure 4:
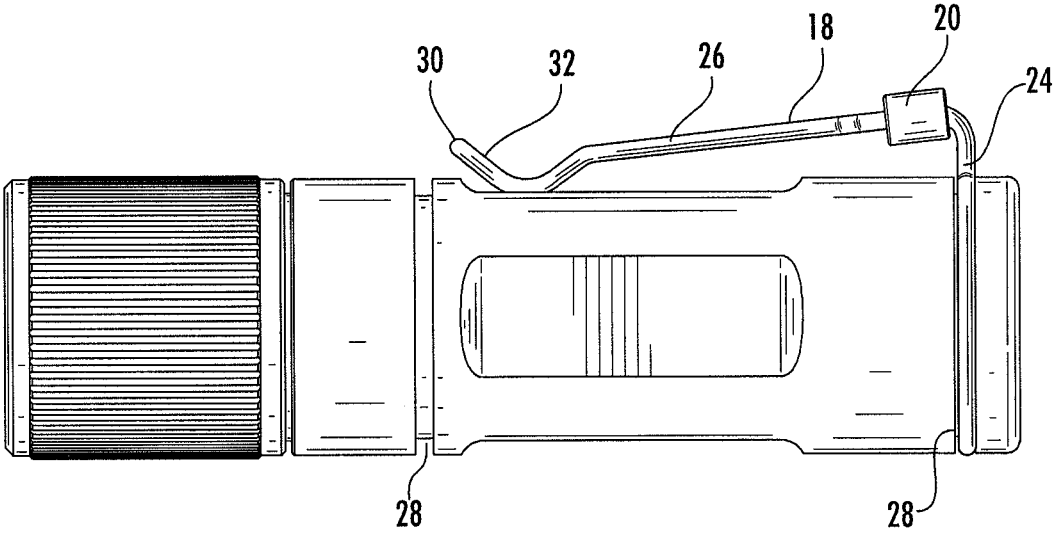
FIG. 4 is a side view of the article including a clip of FIG. 1.

The clip portion 26 extends from the engagement portion 24, such as in a lengthwise direction along the item. The clip portion may include first and second leg members having respective interconnected distal portions 30 to thereby define an elongated U-shaped configuration. In this embodiment, the first leg member may be attached to and extend continuously from the first arm of the engagement portion, while the second leg member may be attached to and extend continuously from the second arm of the engagement portion. As illustrated in FIG. 4, the clip portion extends in a lengthwise direction along the item and has at least a portion that is generally tapered or angled inward toward the item. In this regard, the clip portion is generally offset or spaced from the item at the end proximate the engagement portion. However, the clip portion is generally angled inward toward the item such that the distal end or a segment of the clip portion relatively near the distal end makes contact with or is relatively closely positioned to the item, such as the housing of the flashlight 12 in the illustrated embodiment. By making contact with or being closely spaced from the item, the clip 10 can be affixed to an article, such as a piece of clothing, the bill of a cap or the like, by inserting the article between the clip portion and the item, thereby displacing the distal end of the clip portion and urging the distal end of the clip portion away from the item. As such, the resilient or spring-like nature of the clip portion will secure the article between the clip portion and the item so as to temporarily affix the clip and the associated item to the article. In order to facilitate insertion of the article between the distal end of the clip portion and the item, the distal end of the clip portion may include an angled portion 32 extending at an angle outward from the item, as shown in the illustrated embodiment.

The clip 10 also includes a sleeve 20 slidably positioned upon the clip portion 26. The sleeve may be a closed annular shape or may define an opening as shown in FIG. 3. The sleeve is configured to translate along the clip portion between a first position proximate the engagement portion 24 as shown in FIGS. 1-4, and a second position spaced apart from the engagement portion. The second position may be along the medial portion of the clip portion or near the distal end of the clip portion. In the first position, the sleeve interacts with the clip member so as to hold the first and second arms together to cause the engagement portion to grip the item. In contrast, in the second position, the sleeve interacts with the clip portion to permit disengagement of the engagement portion from the item, such as by permitting the first and second arms to be separated or spread from one another.

The sleeve 20 may be formed of the same material as the clip member, such as 420 spring stainless steel in one example, or may be formed of a different material, such as a plastic, rubber, fiberglass or metal material. In the embodiment of FIGS. 1-4, the sleeve defines an opening having a width that may be approximately equal to or slightly greater than the width of the clip portion 26, as measured from the outside surface of the first leg member to the outside surface of the second leg member. As such, the sleeve is generally configured to slide along the clip portion. However, the clip portion may include at least one stop 34, typically formed by outwardly protruding portions of one or both leg members. The stop serves to hold the sleeve in the first position proximate the engagement portion 24. In this regard, the stop is generally positioned at a position along the clip member that is spaced apart from the engagement portion. As shown in FIGS. 1 and 2, for example, the stop may be positioned closer to the engagement portion than to the distal end 30 of the clip portion. In the illustrated embodiment, for example, the stop is spaced apart from the engagement portion by a distance equal to or somewhat greater than the length of the sleeve such that the sleeve in the first position may be seated between the engagement portion and the stop such that the stop retains the sleeve in a relatively snug position proximate the engagement portion. In contrast to the capability of the sleeve of this embodiment to be slid relatively easily along the remainder of the clip portion, the stop restricts movement of the sleeve since the width of the stop is greater than the nominal width of the opening defined by the sleeve, that is, the width of the opening defined by the sleeve in the absence of any externally applied forces.

Figure 5A:
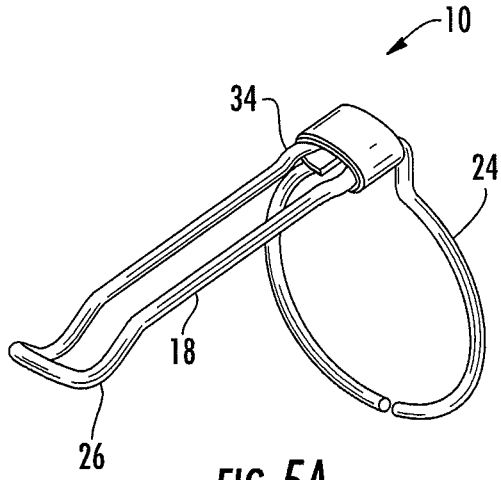
FIGS. 5A-5C are a sequential series of perspective views of a clip according to embodiments of the present invention which illustrate the initial engagement of the clip to an item and the subsequent disengagement of the clip from the item.
Figure 5B:
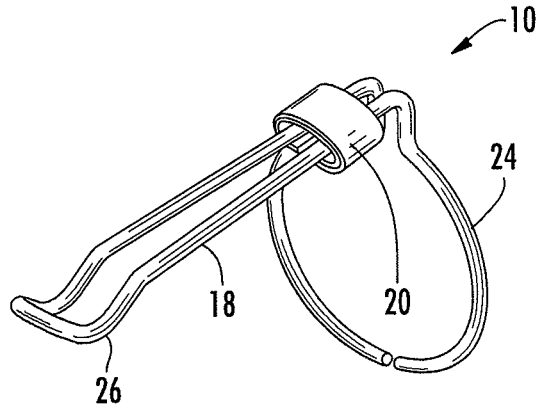
Figure 5C:
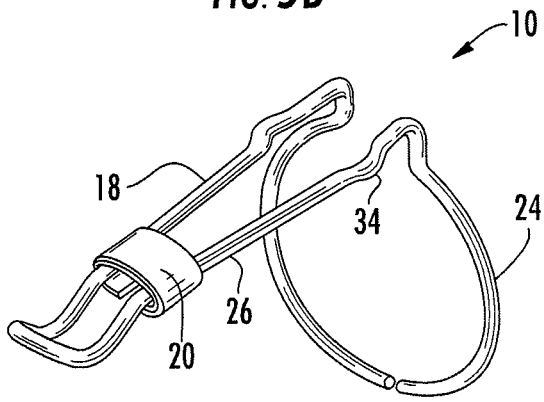

Although the stop 34 serves to retain the sleeve 20 proximate the engagement portion 24 and therefore maintains the grip of the engagement portion upon the item, a person may advance the sleeve past the stop, if so desired, such as in instances in which the clip is to be removed from the item. In this regard, a person can grasp the sleeve when the sleeve is in the first position, as shown in FIG. 5A, and then move the sleeve up along the clip portion. As the sleeve advances over the stop, the first and second leg members are configured to move or be deflected toward one another, as shown in FIG. 5B. In order to facilitate the advancement of the sleeve over the stop, the stop is generally defined to have a relatively smoothly curved shape. Once the sleeve has been advanced beyond the stop, the sleeve may be further slid along the clip portion to a second position. Once the sleeve has been slid to the second position, a person may disengage the engagement portion from the item by spreading the first and second arms of the engagement portion apart from one another and separating the clip from the item, as shown in FIG. 5C.

In order to prevent the sleeve 20 from being readily disengaged from the clip member 18 and potentially being lost or misplaced, the distal end 30 of the clip portion 26 may be shaped or sized to prevent the accidental removal of the sleeve from the clip member. In this regard, the distal end of the clip portion may define a V-shape as shown in FIG. 4 that prevents or at least retards the further advancement of the sleeve and the accident removal of the sleeve from the clip member. Alternatively, the distal end of the clip portion could be formed to have a greater width than the medial portion of the clip portion with the greater width of the distal end of the clip portion being greater than the width of the sleeve so as to retain the sleeve upon the clip portion.

Once removed, the item may be used without the clip 10, thereby somewhat reducing the form factor of the item. Thereafter, the clip may again be mounted to the item by reversing the foregoing steps, such as by spreading the first and second arms of the engagement portion 24 and placing the engagement portion about the item. The sleeve 20 may then be slid from the second position over the stop 34 to the first position in order to cause the engagement portion to again grip the item. Although the clip may be reattached to the item in the same position and orientation relative to the item, the clip may, instead, be attached to another portion of the item or in another orientation relative to the item.

Figure 6:
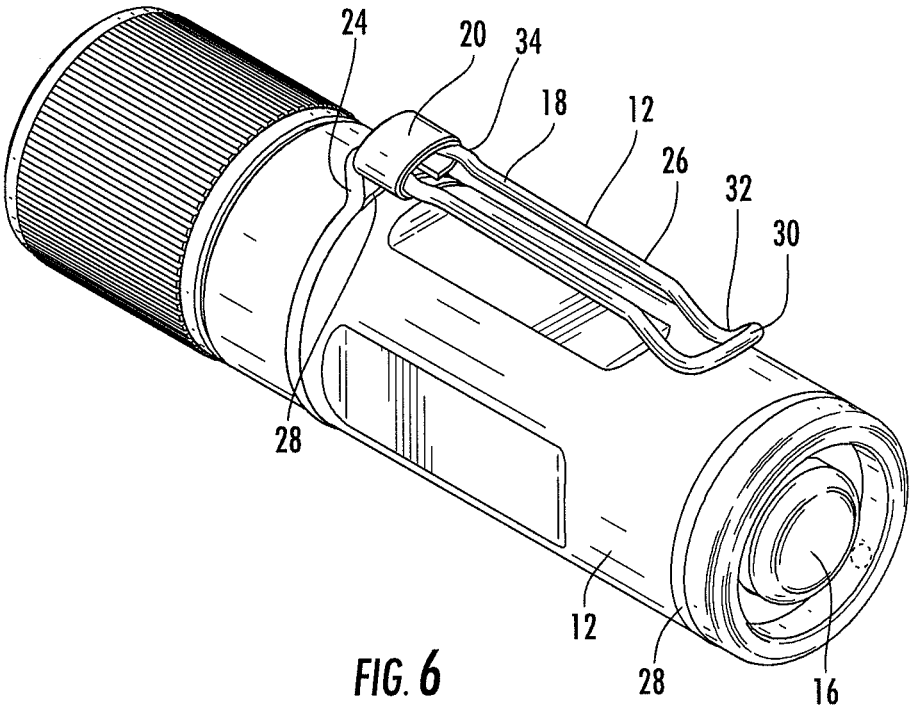
FIG. 6 is a perspective view of an article including a clip according to one embodiment of the present invention in which the clip is differently positioned relative to the item than that depicted in FIGS. 1-4.

As shown in FIG. 6, for example, the clip 10 may be reattached to the flashlight 12 with the engagement portion 24 being attached at a location that is not proximate the second end of the flashlight, but is, instead, in a medial portion of the flashlight. Additionally, the orientation of the clip relative to the flashlight may be reversed such that while the clip portion 26 still extends in a lengthwise direction along the flashlight, the clip portion extends in the opposite direction. In order to facilitate the repositioning of the clip relative to the item, the item may define additional circumferential grooves 28 that are sized and shaped to receive the engagement member with each groove being associated with a different position of the clip relative to the item. The capability to reposition and reorient the clip relative to the item may be advantageous in order to facilitate different uses of the item. With respect to a flashlight, for example, the clip may typically be attached to the flashlight as shown in FIG. 1 such that the flashlight may be clipped onto an article of clothing, such as a pocket, a belt or the like, with the lens 14 facing downward and the switch 16 facing upwards to facilitate ready access by the user to the flashlight. Once in use, however, a user may desire to operate the flashlight in a hands-free manner with the flashlight attached to the bill of a cap or the like. In this instance, the clip may be detached from the flashlight and then reattached to the flashlight with the clip portion extending in the opposite direction as shown in FIG. 6. As such, the flashlight having the clip positioned as shown in FIG. 6 may be attached to the bill of a cap or the like so as to permit the light provided by the flashlight to illuminate the workspace. Once the task is completed, the user may again disengage the clip and then reattach the clip in the position shown in FIGS. 1 and 2.

Figure 7:
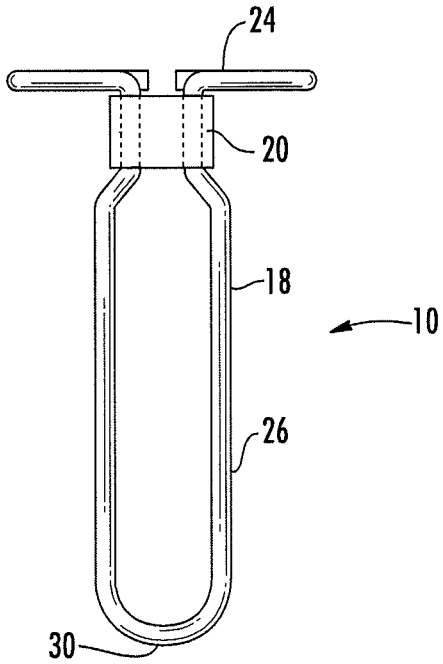
FIG. 7 is a top view of a clip according to another embodiment of the present invention.

Although the clip 10 of one embodiment has been illustrated and described above, the clip may have other configurations without departing from the spirit and scope of the present invention. As shown in FIG. 7, for example, the clip portion 26 may be configured to have a first region with a smaller width proximate the engagement portion. In instances in which the clip is mounted upon an item, the sleeve 20 may be positioned within this first region of the clip portion. The remainder of the clip portion may have a greater width, that is, greater than the first region of the clip portion and greater than the nominal width of the sleeve. In order to disengage the clip from the item, the sleeve may be moved from the first region and urged along the clip portion so as to deflect the first and second leg members of the clip portion towards one another. To facilitate movement of the sleeve from the first region to the remainder of the clip portion, the clip portion may define a smoothly shaped or curved transition. Once the sleeve has been slid along the clip portion toward the distal end 30, the clip may be removed from the item. Because of the interaction of the sleeve and the clip portion, the clip portion of this embodiment may, but need not include additional features proximate the distal end in order to prevent the sleeve from being accidentally removed from the clip portion since the interaction of the clip portion and the sleeve accomplishes this same function by requiring at least some effort to remove the sleeve from the clip portion.

Figure 8:
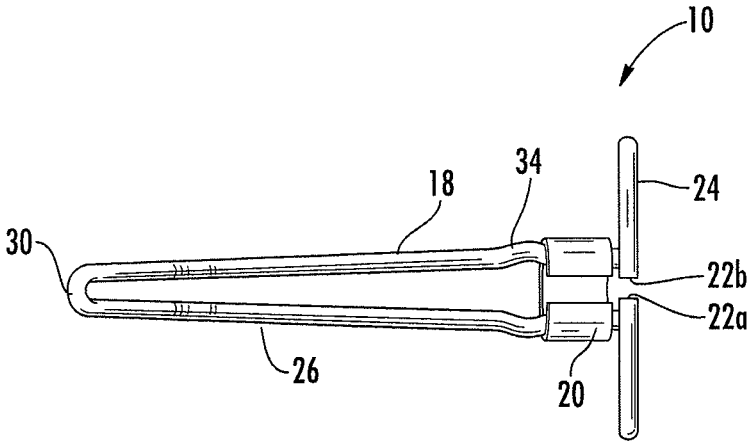
FIG. 8 is a bottom view of a clip according to yet another embodiment of the present invention.

Additionally, while the clip portion 26 has been described heretofore to have first and second leg members that extend in a generally parallel arrangement along a portion of the housing of the flashlight 12 so as to define a U-shape, the clip 10 of another embodiment depicted in FIG. 8 need not have first and second leg members that extend in parallel. Instead, the first and second leg members may be tapered from a wider spacing proximate the stop 34 or engagement portion 24 to a narrower spacing proximate the distal end 30. While the first and second leg members of this embodiment may taper in various manners, the first and second leg members of the embodiment illustrated in FIG. 8 taper in the same, linear manner. By being tapered, the movement of the sleeve 20 along the clip portion is facilitated with the tapered shape encouraging the movement of the sleeve toward the distal end once the sleeve is forcibly moved beyond the stop, thereby also facilitating the opening or spreading of the engagement portion to permit removal of the clip from the flashlight.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A clip comprising:

a clip member extending continuously between first and second opposed ends, wherein the clip member comprises an engagement portion configured to extend about a majority of a circumference of an item, wherein the clip member further comprises a clip portion comprising first and second leg members that are configured to extend from the engagement portion in a lengthwise direction along the item and at least one stop that is positioned along at least one of the first and second members, and wherein the engagement portion extends in a first direction from the clip portion and the clip portion includes a distal end portion that is angled in the first direction toward the item relative to another portion of the clip portion proximal to the engagement portion and a sleeve slidably positioned upon the clip portion and configured to translate along the clip portion between a first position proximate the engagement portion to cause the engagement portion to grip the item and a second position spaced apart from the engagement portion to permit disengagement of the engagement portion from the item, wherein the at least one stop is positioned between the first and second positions, and wherein the first and second leg members are configured to move toward one another in an instance in which the sleeve is advanced over the stop during a transition from the first position to the second position.

2. A clip according to claim 1 wherein the first and second leg members have respective interconnected distal portions.

3. A clip according to claim 2 wherein the at least one stop has a width greater than a nominal width of the sleeve.

4. A clip according to claim 3 wherein the at least one stop is defined by an outwardly protruding portion of at least one of the first and second leg members.

5. A clip according to claim 4 wherein the outwardly protruding portion extends to the interconnected distal portions of the first and second leg members.

6. A clip according to claim 2 wherein the first and second leg members are tapered so as to have a wider spacing therebetween proximate the engagement portion and a narrower spacing therebetween proximate the interconnected distal portions.

7. A clip according to claim 1 wherein the engagement portion comprises first and second arms configured to extend partially circumferentially about the item.

8. A clip according to claim 1 wherein the distal end portion of the clip portion defines a V-shape.

9. A clip according to claim 1 wherein the first and second leg members extend in parallel to one another.

10. A clip according to claim 1 wherein the stop is located closer to the engagement portion than to a distal end of the clip portion.

11. A clip according to claim 1 wherein the stop is spaced apart from the engagement portion by a distance equal to a length of the sleeve.

12. A clip comprising:

a clip member comprising an engagement portion defining an open loop and a clip portion extending from the engagement portion, wherein the engagement portion is configured to extend about a majority of a circumference of an item, wherein the clip portion comprises first and second leg members, and wherein the engagement portion extends in a first direction from the clip portion and the clip portion includes a distal end portion that is angled in the first direction toward the item relative to another portion of the clip portion proximal to the engagement portion; and a sleeve slidably positioned upon the clip portion, wherein the clip portion includes at least one stop having a width greater than a nominal width of the sleeve, wherein the at least one stop is defined by a portion of at least one of the first and second leg members that protrudes outwardly relative to other portions of the at least one of the first and second leg members while the sleeve is on a first side of the stop proximate the engagement portion and while the sleeve is on an opposite side of the stop.

13. A clip according to claim 12 wherein the first and second leg members have respective interconnected distal portions.

14. A clip according to claim 13 wherein the first and second leg members are configured to move toward one another in instances in which the sleeve is advanced over the stop.

15. A clip according to claim 12 wherein the outwardly protruding portion extends to the interconnected distal portions of the first and second leg members.

16. A clip according to claim 13 wherein the first and second leg members are tapered so as to have a wider spacing therebetween proximate the engagement portion and a narrower spacing therebetween proximate the interconnected distal portions.

17. A clip according to claim 12 wherein the engagement portion comprises first and second arms configured to extend partially circumferentially about the item.

18. A clip according to claim 12 wherein a the distal end portion of the clip portion defines a V-shape.

19. A clip according to claim 12 wherein the first and second leg members extend in parallel to one another.

20. A clip according to claim 12 wherein the stop is located closer to the engagement portion than to a distal end of the clip portion, and wherein the stop is spaced apart from the engagement portion by a distance equal to a length of the sleeve.

* * * * *